US008432324B2

(12) United States Patent
Chen

(10) Patent No.: US 8,432,324 B2
(45) Date of Patent: Apr. 30, 2013

(54) ANTENNA MODULE AND COMMUNICATION DEVICE HAVING THE SAME

(75) Inventor: Lung-Pao Chen, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 408 days.

(21) Appl. No.: 12/878,957

(22) Filed: Sep. 9, 2010

(65) Prior Publication Data

US 2012/0038517 A1 Feb. 16, 2012

(30) Foreign Application Priority Data

Aug. 13, 2010 (CN) ..... 2010 1 0253524

(51) Int. Cl.
*H01Q 1/24* (2006.01)

(52) U.S. Cl.
USPC ..... 343/702; 343/893

(58) Field of Classification Search ..... 343/702, 343/700 MS, 893
See application file for complete search history.

(56) References Cited

U.S. PATENT DOCUMENTS 6,549,169 B1 * 4/2003 Matsuyoshi et al. ..... 343/702
6,847,328 B1 * 1/2005 Libonati et al. ..... 343/700 MS
2008/0143610 A1 * 6/2008 Wang et al. ..... 343/702

* cited by examiner

*Primary Examiner* — Dieu H Duong
(74) *Attorney, Agent, or Firm* — Altis Law Group, Inc.

(57) ABSTRACT

An antenna module includes a first antenna and a second antenna which work at the same frequency. The first antenna includes a first feed portion, a first radiation portion, and a first ground portion. The second antenna includes a second feed portion and a second radiation portion. The first radiation portion is arc-shaped. The second radiation portion includes an arced edge and is coupled to the first radiation portion via the arced edge. The first feed portion and the second feed portion are connected to a signal terminal of a printed circuit board of a communication device and configured for feeding in electromagnetic waves. The ground portion is connected to a ground of the printed circuit board.

9 Claims, 3 Drawing Sheets

ANTENNA MODULE AND COMMUNICATION DEVICE HAVING THE SAME

BACKGROUND

1. Technical Field

The present disclosure relates to an antenna module and a communication device using the antenna module.

2. Description of Related Art

Current communication devices often come with more than one wireless transmission system, such as a WI-FI system and a BLUETOOTH system, each of which employs a corresponding internal printed antenna. The areas of the inner printed antennas are limited because of the miniaturization of the communication device, adversely affecting the performance of the antennas.

Therefore, it is desirable to provide an antenna module and a communication device having the same, which can overcome the above-mentioned limitations.

BRIEF DESCRIPTION OF THE DRAWINGS

Many aspects of the present disclosure should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of the present disclosure will now be described in detail with reference to the drawings.

Figure 1:
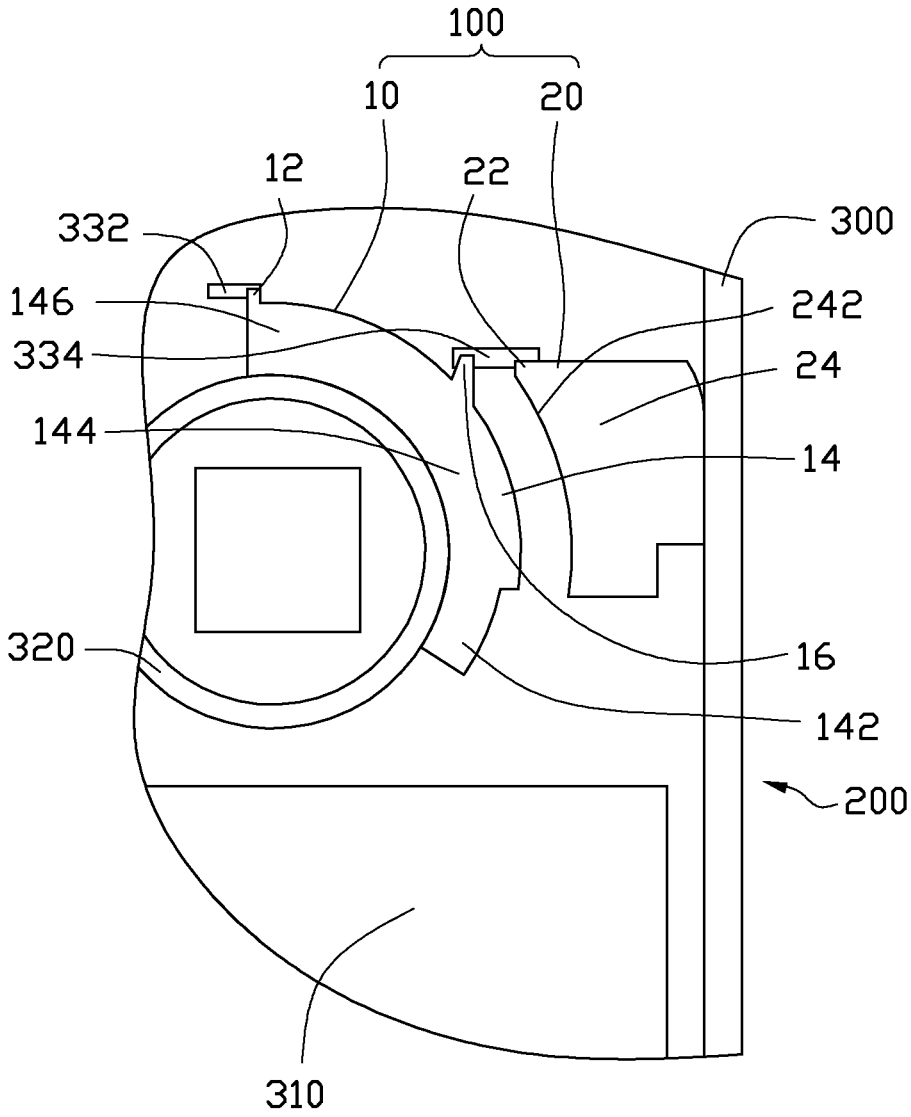
FIG. 1 is a schematic view of an antenna module and a communication device having the same, according to an embodiment.

Referring to FIG. 1, an antenna module 100, according to an embodiment, is printed on a shell 300 of a communication device 200. In addition to the shell 300, the communication device 200 also includes a printed circuit board (PCB, not shown) received in the shell 300. A lower portion of the shell 300 defines a battery groove 310 for receiving a battery (not shown) of the communication device 200. An upper portion of the shell 300 defines a through hole 320, generally at the center thereof, for receiving a camera module (not shown) of the communication device 200. The upper portion of the shell 300 also defines a first slot 332 and a second slot 334. The first slot 332 is positioned at a side of the through hole 320 opposite to the battery groove 310. The second slot 334 is generally positioned at a middle portion between the first slot 332 and a right edge of the shell 300. In this embodiment, the communication device 200 is a mobile phone.

The antenna module 100 includes a first antenna 10 and a second antenna 20, which are positioned between the through hole 320 and the right edge of the shell 300. The first antenna 10 includes a first feed portion 12, a first radiation portion 14, and a ground portion 16. The second antenna 20 includes a second feed portion 22 and a second radiation portion 24.

The first radiation portion 14 is an arc-shaped sheet, fittingly surrounding the through hole 320. The second radiation portion 24 is positioned at a side, e.g., the left side, of the first radiation portion 14. The second radiation portion 24 includes an arced edge 242 and is coupled to the first radiation portion 14 by the arced edge 242. As such, the second radiation portion 24 can function as a direction guiding element of the first radiation portion 14 and helps guide the direction of electromagnetic waves radiated from the first radiation portion 14 such that the first radiation portion 14 can efficiently radiate the electromagnetic waves. The first radiation portion 14 can function as a reflective element of the second radiation portion 24 to reflect electromagnetic waves radiated from the second radiation portion 24 so that the radiation effect of the second radiation portion 24 is enhanced.

The first radiation portion 14 forms an arc that subtends an angle of about $2\pi/3$ (e.g., 130°) and includes a first section 142 that is adjacent to the battery groove 310, a second section 144 that extends from the first section 142 to the second slot 334, and a third section 146 that extends from the second section 144 to the first slot 332. The first section 142, the second section 144, and the third section 146 form arcs that subtend angle of about $\pi/9$ (e.g., 23°), $\pi/4$ (e.g., 45°), and $\pi/3$ (e.g., 62°), respectively. The width of the first section 142 is slightly smaller than those of the second section 144 and the third section 146. The arced edge 242 forms an arc that subtends an angle generally equal to that of the second section 144 and aligned with the second section 144. The second radiation portion 24 extends from the arced edge 242 to the right edge of the shell 300 and is generally rectangular.

The first feed portion 12 extends from the first radiation portion 14, the second feed portion 22 extends from the second radiation portion 24, and the first feed portion 12 and the second feed portion 22 are connected to a signal terminal of the PCB of the communication device 200 and configured for feeding in electromagnetic waves. In particular, the first feed portion 12 is a rectangular strip extending from the third section 146 into the first slot 332, and the second feed portion 22 is a rectangular strip extending from the second radiation portion 24 into the second slot 334.

The ground portion 16 extends from the first radiation portion 14 and is configured for connecting the first radiation portion 14 to the ground of the PCB of the communication device 200.

Figure 2:
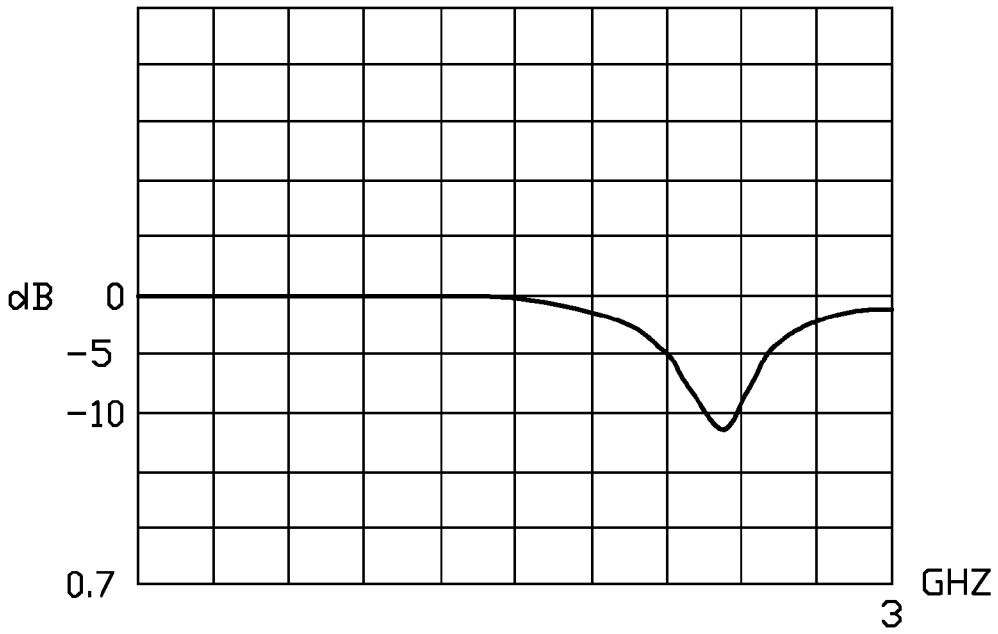
FIG. 2 is a graph showing the relationship between the return loss and the working frequency of a first antenna of the antenna module of FIG. 1.

In this embodiment, the first antenna 10 is a BLUETOOTH compliant antenna, working at about 2.4 GHz. As illustrated in FIG. 2, around 2.4 GHz, the return loss of the first antenna 10 is less than −10 dB, satisfying the corresponding industrial standard. In addition, the return loss of the first antenna 10 can approach about −10.7 dB when working at about 2.445 GHz.

Figure 3:
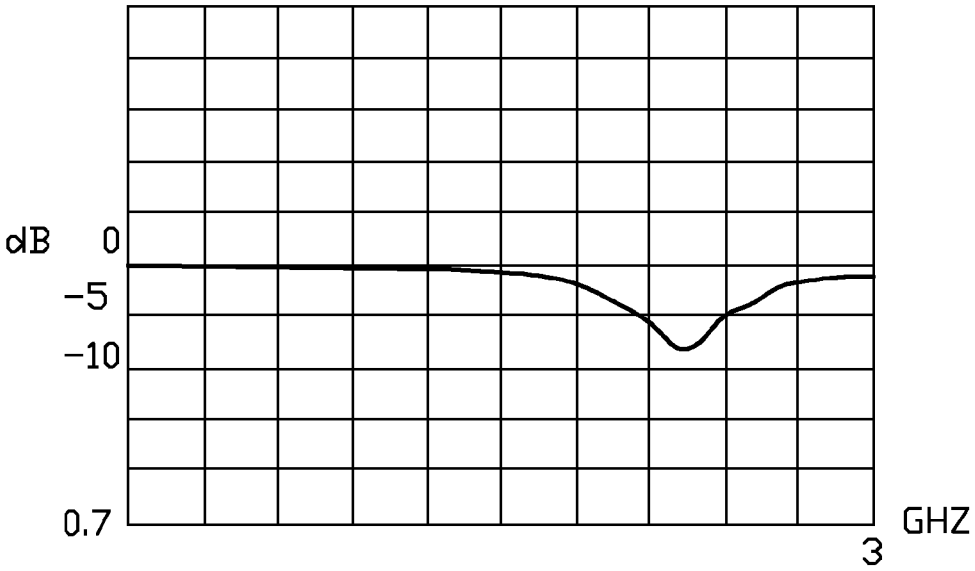
FIG. 3 is another graph showing the relationship between the return loss and the working frequency of a second antenna of the antenna module of FIG. 1.

The second antenna 20 is a WI-FI compliant antenna, also working at about 2.4 GHz. As illustrated in FIG. 3, around 2.4 GHz, the return loss of the second antenna 20 is less than −7 dB, satisfying the respective industrial standard. In addition, the return loss of the second antenna 20 can approach about −7.3 dB when working at about 2.45 GHz.

It will be understood that the above particular embodiments and methods are shown and described by way of illustration only. The principles and the features of the present disclosure may be employed in various and numerous embodiment thereof without departing from the scope of the disclosure as claimed. The above-described embodiments illustrate the scope of the disclosure but do not restrict the scope of the disclosure.

What is claimed is:

1. An antenna module for a communication device comprising a printed circuit board, the antenna module comprising:

a first antenna comprising:

a first feed portion;

a first radiation portion which is arc-shaped; and a first ground portion configured for connecting to a ground of the printed circuit board; and a second antenna comprising:

a second feed portion; and a second radiation portion comprising an arced edge, the second radiation being coupled to the first radiation portion via the arced edge;

wherein the first and second antennas work at the same frequency, and the first feed portion and the second feed portion are configured for connecting to a signal terminal of the printed circuit board and feeding in electromagnetic waves;

wherein the first radiation portion forms an arc that subtends an angle of about $2\pi/3$.

2. The antenna module of claim 1, wherein the first radiation portion comprises a first section, a second section that extends from the first section, and a third section that extends from the second section, which form arcs that subtend angles of $\pi/9$, $\pi/4$, and $\pi/3$, respectively.

3. The antenna module of claim 2, wherein the width of the first section is slightly smaller than those of the second section and the third section.

4. The antenna module of claim 2, wherein the arced edge forms an arc that subtend an angle generally equal to that of the second section and aligned with the second section.

5. A communication device comprising:

a printed circuit board;

a shell comprising an upper portion, the upper portion defining a through hole for receiving a component of the communication device; and an antenna module printed on the shell and comprising a first antenna and a second antenna which work at the same frequency;

wherein the first antenna comprises a first feed portion, a first radiation portion, and a first ground portion; the second antenna comprises a second feed portion and a second radiation portion; the first radiation portion are arc-shaped and surrounds the through hole, the second radiation portion comprises an arced edge and is coupled to the first radiation portion via the arced edge, the first feed portion and the second feed portion are connected to a signal terminal of the printed circuit board and configured for feeding in electromagnetic waves, the ground portion is connected to a ground of the printed circuit board.

6. The communication device of claim 5, wherein the first radiation portion forms an arc that subtends an angle of about $2\pi/3$.

7. The communication of claim 6, wherein the first radiation portion comprises a first section, a second section that extends from the first section, and a third section that extends from the second section, which form arcs that subtend angles of $\pi/9$, $\pi/4$, and $\pi/3$, respectively.

8. The communication device of claim 7, wherein the width of the first section is slightly smaller than those of the second section and the third section.

9. The communication device of claim 7, wherein the arced edge forms an arc that subtend an angle generally equal to that of the second section and aligned with the second section.

* * * * *